US005577931A

United States Patent [19]

Leshem

[11] Patent Number: 5,577,931

[45] Date of Patent: Nov. 26, 1996

[54] TWO-CHANNEL SCSI-COMPATIBLE INTERCONNECT SYSTEM AND METHOD

[75] Inventor: Eli Leshem, Brookline, Mass.

[73] Assignee: EMC Corporation, Hopkinton, Mass.

[21] Appl. No.: 279,785

[22] Filed: Jul. 25, 1994

[51] Int. Cl.[6] ..... H01R 11/00

[52] U.S. Cl. ..... 439/497; 174/117 F

[58] Field of Search ..... 174/117 F, 117 FF; 439/497, 442, 494

[56] References Cited

U.S. PATENT DOCUMENTS

| | | | |
|---|---|---|---|
| 3,447,120 | 5/1969 | Rask et al. | 439/497 |
| 3,764,727 | 10/1973 | Balde | 174/117 FF |
| 4,149,026 | 4/1979 | Fritz et al. | 174/117 F |
| 4,155,613 | 5/1979 | Brandeau | 439/90 |
| 4,157,612 | 6/1979 | Rainal | 439/497 |
| 4,820,175 | 4/1989 | Hasegawa et al. | 439/98 |
| 4,988,890 | 1/1991 | Narhi et al. | 439/505 |
| 5,051,544 | 9/1991 | Harris | 174/117 F |
| 5,099,137 | 5/1992 | Lattin, Jr. | 307/147 |

*Primary Examiner*—Neil Abrams
*Assistant Examiner*—Barry Matthew L. Standig
*Attorney, Agent, or Firm*—Daniel J. Bourque; Kevin J. Carroll

[57] ABSTRACT

In one embodiment of a two-channel SCSI-compatible interconnection system and method, a dielectric material into which SCSI data and control signal carrying wires are embedded frees ground wires in the SCSI cable to carry first and second SCSI channels so that one conventional SCSI cable and cable connector can support two separate SCSI channels without signal ground wires. In another embodiment of a two-channel SCSI compatible interconnection system and method, a high-density, 100 position dual channel SCSI connector having connector positions doubled in number and spaced at halved intervals relative to a conventional SCSI cable connector supports two separate SCSI channels. In this embodiment, a single one hundred (100) wire SCSI cable or two (2) fifty (50) wire SCSI cables may be attached to the high-density dual channel SCSI connector. In all embodiments, the SCSI channel handling capability is effectively doubled over the heretofore known SCSI connectors for a given connector size or footprint.

12 Claims, 3 Drawing Sheets

TWO-CHANNEL SCSI-COMPATIBLE INTERCONNECT SYSTEM AND METHOD

CROSS REFERENCED TO RELATED APPLICATIONS

This invention is related to co-pending application entitled Two-Channel SCSI-Connector and Method assigned to the same assignee as herein and filed on even date herewith, and identified as Ser. No. 08/279,788.

FIELD OF THE INVENTION

This invention is related to the field of electrical interconnectors, and more particularly, to a novel two-channel SCSI-compatible interconnection system and method.

BACKGROUND OF THE INVENTION

The small computer system interface (SCSI) is a specification (ANSI standard X3.131-1986) for a peripheral bus and command set that defines a high performance peripheral interface that distributes data between a host or controller and a number of peripherals, independently of the host or controller. The SCSI interface works by masking the internal structure of the peripherals from the host computer and uses an eight-port bus that can accommodate either single or multiple-host systems.

The SCSI bus typically has a total of eighteen (18) defined signal lines. Nine (9) are used for control and nine (9) are used for data (eight (8) data lines and one (1 parity line). The data lines are bi-directional and transfer data, commands, status and message information. The control signals and the bus phases determine when and in what direction data is transferred.

The SCSI bus supports two electrical specifications, so-called single-ended and differential. The single-ended version uses TTL logic levels (0 to 5 volts), while the differential uses EIA RS-485 signals to allow longer cables. The present invention is particularly well suited for the single-ended electrical specification.

The SCSI bus is defined as including fifty (50) lines or signals, of which, as mentioned, nine (9) are data signals (including parity) and nine (9) are control signals. The following table contains the pin assignments for the single-ended signals. For the single-ended signals, all odd numbered lines plus the lines numbered twenty (20) twenty-two (22), twenty-four (24), twenty-eight (28), thirty (30), and thirty-four (34) are connected to ground on the controller and pin twenty-five (25) is left open.

TABLE I

| Pin | Mnemonic | Signal | Driven By |
|---|---|---|---|
| 2 | -DBO | Data Bus Line 0 | Initiator/Target |
| 4 | -DBl | Data Bus Line 1 | Initiator/Target |
| 6 | -DB2 | Data Bus Line 2 | Initiator/Target |
| 8 | -DB3 | Data Bus Line 3 | Initiator/Target |
| 10 | -DB4 | Data Bus Line 4 | Initiator/Target |
| 12 | -DB5 | Data Bus Line 5 | Initiator/Target |
| 14 | -DB6 | Data Bus Line 6 | Initiator/Target |
| 16 | -DB7 | Data Bus Line 7 | Initiator/Target |
| 18 | -DBP | Data Bus Parity | Initiator/Target |
| 26 | -TERMPWR | Terminator Power | Any device |
| 32 | -ATN | Attention | Initiator |
| 36 | -BSY | Busy | Initiator/Target |
| 38 | -ACK | Acknowledge | Initiator |
| 40 | -RST | Reset | Any device |
| 42 | -MSG | Message | Target |
| 44 | -SEL | Select | Initiator/Target |

TABLE I-continued

| Pin | Mnemonic | Signal | Driven By |
|---|---|---|---|
| 46 | -C/D | Control/Data | Target |
| 48 | -REQ | Request | Target |
| 50 | -I/O | Input/Output | Target |

A typical single-channel SCSI cable connector of the prior art is comprised of a flat ribbon cable of fifty (50) wires in width. Every other wire of the fifty (50) wire flat ribbon cable is connected to ground to eliminate cross-talk between the adjoining wires that carry the data and control signals. The flat ribbon cable is typically enclosed in a low-cost insulator, such as polyvinyl chloride (PVC). The fifty (50) wire flat ribbon cable is terminated on each of its ends in a two (2) row by twenty-five (25) pin cable connector. The pins or elements of the SCSI cable connectors are spaced apart from each other in a given row on one hundred thousandths (0.100) inch spacings. Each of the pins of the two (2) row by twenty-five (25) pin SCSI cable connectors are preassigned one of the different single-ended SCSI bus signals as defined in the table above.

The SCSI bus can communicate on one end with one, or more than one, host computer or controller and on the other end can communicate with up to eight (8) peripheral devices. If the host is internally SCSI compatible, the bus may be directly connected to the host. Otherwise, a host adapter or SCSI controller may be provided between the one or more host computers and the SCSI bus to communicate using the SCSI protocol on one end and to communicate with the one or more host computer bus on the other end. To adapt the peripherals to the SCSI bus, a SCSI bus controller is used. The controller communicates the SCSI protocol on one end and communicates with the peripherals on the other end.

The SCSI bus controller typically includes an interconnection board having a plurality of connectors, a two (2) by twenty-five (25) SCSI cable connector being required for each of the peripherals to be controlled by the bus controller. In many large computer systems, thirty-two (32) SCSI buses are employed to connect one hundred twenty-eight (128) SCSI controlled peripherals such as disk drives to the host computer. Since each drive requires a corresponding dedicated connector on the bus controller interconnection board, (thus 128 connectors) it is desirable to provide a means and method for reducing the number of SCSI connectors required to support an array of SCSI peripherals, thereby greatly reducing the amount of board space ("real estate") required to support such a large number of peripheral devices.

SUMMARY OF THE INVENTION

It is accordingly the principal object of the present invention to provide a two-channel SCSI-compatible interconnection system and method that doubles the SCSI channel carrying capacity in generally the same space or area of an interconnection board.

In accord with one embodiment of the present invention, a system and method are disclosed that eliminate cross-talk between the control and data wires of the fifty (50) wire flat ribbon SCSI cable, thereby freeing the ground wires to carry control and data information for a separate second channel. In this embodiment, means and method are disclosed that terminate the freed ground wires as well as the control and data wires in such a manner that two (2) SCSI channels exist on one (1) flat ribbon SCSI cable connector which previously carried only one SCSI channel.

In a first embodiment, cross-talk is eliminated by embedding each of the fifty (50) wires of the flat ribbon cable in an insulative sheath whose dielectric constant is selected to eliminate cross-talk between the several wires, such as an insulative sheath of TEFLON®, a registered trademark of the Dupont Company. In the preferred embodiment, each wire of the fifty (50) wire flat ribbon cable is terminated in a single two (2) row by twenty-five (25) pin flat ribbon cable connector such that two (2) SCSI channels are supported by each single two (2) row by twenty-five (25) pin connector.

In a first alternative embodiment of a high-density two-channel SCSI-compatible interconnection in accord with the present invention, a system and method are disclosed for providing a high-density SCSI cable connector having two (2) two by fifty (50) pin connector ports whose predetermined dimension, e.g. size or footprint matches the footprint of the previously used two (2) row by twenty-five (25) pin SCSI connectors.

In a first implementation of a second alternative embodiment, a high-density SCSI cable having one hundred (100) wires, providing two (2) grounded SCSI channels, is connected to the high-density connector to provide two (2) SCSI channels in the space occupied previously by a single channel SCSI connector. In a second implementation of the second alternative embodiment, two (2) separate fifty (50) wire flat ribbon SCSI cables are connected at one end to the one high-density connector and at the other end severally to individual lower-density two (2) row by twenty-five (25) pin SCSI connectors. In either alternative embodiment, the cables have ground wires spaced between signal wires that eliminate cross-talk between corresponding control and data wires. In addition, the wires in the alternative embodiments are embedded in an insulative material such as poly-vinyl-chloride (PVC).

BRIEF DESCRIPTION OF THE DRAWINGS

Other objects, advantages and features of the present invention will become apparent to those skilled in the art by having reference to the following detailed description of the preferred embodiments, and to the drawings, wherein:

FIG. 3A is a schematic diagram while FIG. 4A is a schematic diagram whereas

DETAILED DESCRIPTION OF THE PREFERRED EMBODIMENTS

Figure 1:
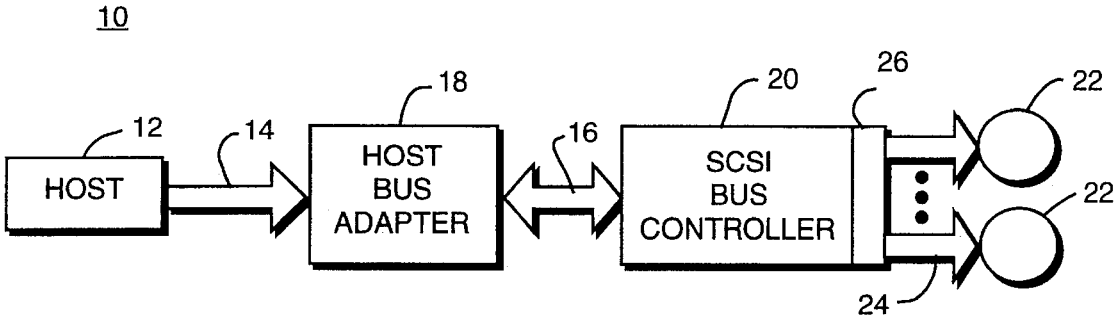
FIG. 1 is a block diagram of the environment of the two-channel SCSI-compatible interconnection system and method of the present invention.

Referring now to FIG. 1, generally designated at 10 is a block diagram of a typical environment of the two-channel SCSI-compatible interconnection system and method of the present invention. At least one host computer 12 having a host bus 14 is connected to a SCSI bus controller 20. The connection to the SCSI bus controller 20 may be made through a host bus adapter 18 and host bus adapter bus 16 in the event that the host and/or host bus 14 are not compatible with the SCSI bus controller 20. One or more peripherals 22 are connected via respective SCSI cables and connectors 24 to an interconnection region 26 on the bus controller 20.

The SCSI cable wire and connectors 24, each in a single-ended configuration, typically include a flat ribbon cable that terminates in a connector that plugs into a mating connector on the interconnection region 20 of the bus controller 20. The SCSI cable wire and connectors 24 of the present invention enable two (2) SCSI channels to be supported at the interconnection region where the prior SCSI connectors only supported a single channel, thereby effectively doubling the SCSI channel handling capability in the same physical space.

Figure 2:
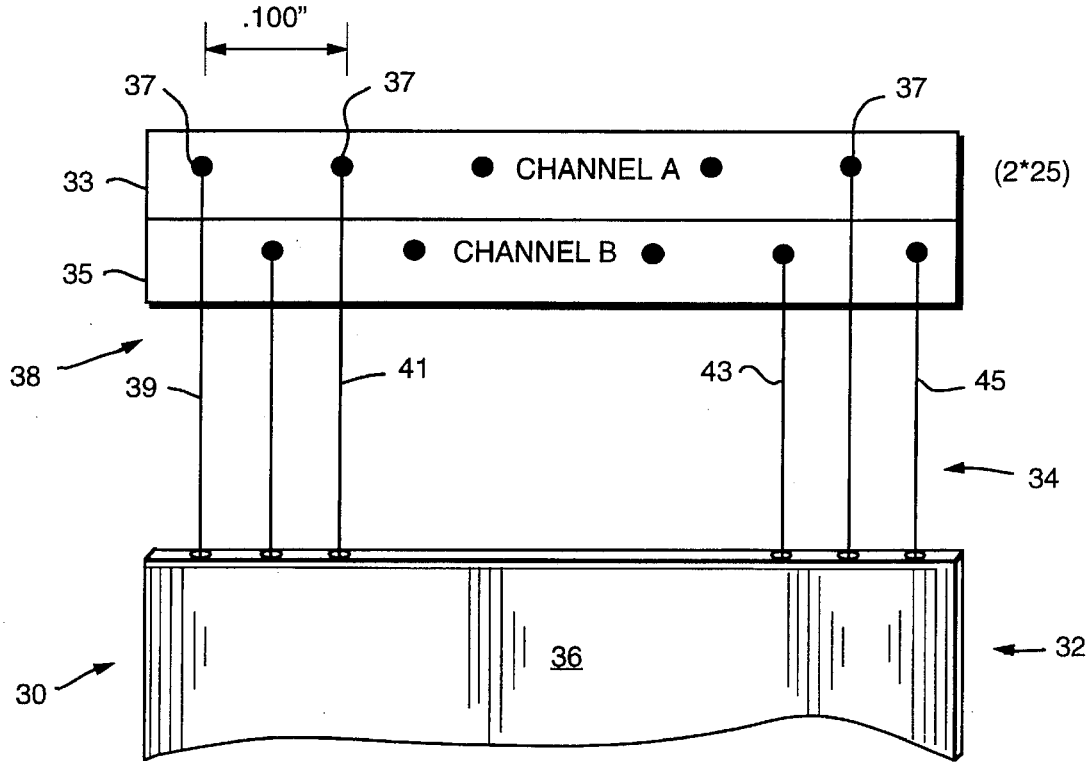
FIG. 2 is a schematic diagram illustrating one embodiment of the two-channel SCSI-compatible interconnection system and method of the present invention.

Referring now to FIG. 2, generally designated at 30 is a schematic diagram of a two-channel SCSI-compatible connector system in accord with one embodiment the present invention. The connector system 30 includes a fifty (50) wire flat ribbon cable generally designated 32. The cable 32 includes fifty (50) wires 34 embedded in an insulative sheath 36. The material of the insulative sheath 36 has a preselected dielectric constant selected to eliminate or minimize cross-talk between the fifty (50) wires 34 of the flat ribbon SCSI cable 32 and thus eliminate the need for a ground signal wire between each data signal or control signal wire as in the prior art. The insulative material includes PTFE commonly sold as TEFLON®, a registered trademark of the Dupont Company. The dielectric properties of the material of the PTFE material of the sheath 36 is in the range of 1.3 to 2.1 which eliminates cross-talk between each adjacent pair of wires 34 of the cable 32, thereby freeing wires previously used as ground wires for use as control and data carrying wires in a separate, second channel. The dielectric constant for standard PVC material, in contrast, is in the range of 3.5 to 8.0.

A conventionally-sized connector generally designated 38 is provided having two (2) rows 33, 35 of twenty-five (25) pins 37 each. The rows are arranged to provide two channels, a channel "A" row 33, and a channel "B" row 35, as illustrated. It should be noted that more than twenty-five (25) pins in a row may be provided if required to accommodate other control signals or protocols, such as "wide" SCSI which would utilize two (2) row by thirty-two (32) pin connectors. One-half (twenty five, (25)) of the fifty (50) wires of the cable 32 (every other wire, odd or even numbered) such as wires 39 and 41 are assigned to and terminated in the first connector row 33 or channel "A" of the connector 38, while the other half (twenty five (25)) of the wires 34 of the cable 32 such as wires 43 and 45 are assigned to and electrically connected with the connector pins in row 35 or channel "B" of the connector 38, as illustrated. Each wire 34 is spaced 0.050" on center and connected to alternating rows 33, 35, in which the pins 37 in a given row are spaced 0.100" apart. Other terminal patterns may of course be employed without departing from the present invention.

The two (2) row by twenty-five (25) pin connector 38 has a footprint that is generally the same as the footprint of the conventional two (2) row by twenty-five (25) pin SCSI connectors, whereby the single connector 38 provides two (20) SCSI channels from the interconnection region or board 26 (FIG. 1) of the bus controller 20 in an area that heretofore was only able to support a single SCSI channel. Thereby, the channel carrying capacity of the interconnector of the bus controller is doubled over the heretofore known SCSI connectors. It should be noted that with the presently available insulating material such as PTFE, eliminating the ground wires altogether is generally possible in cables with lengths not exceeding approximately one (1) foot. As better or different materials are available, this length may be increased.

Figure 3A:
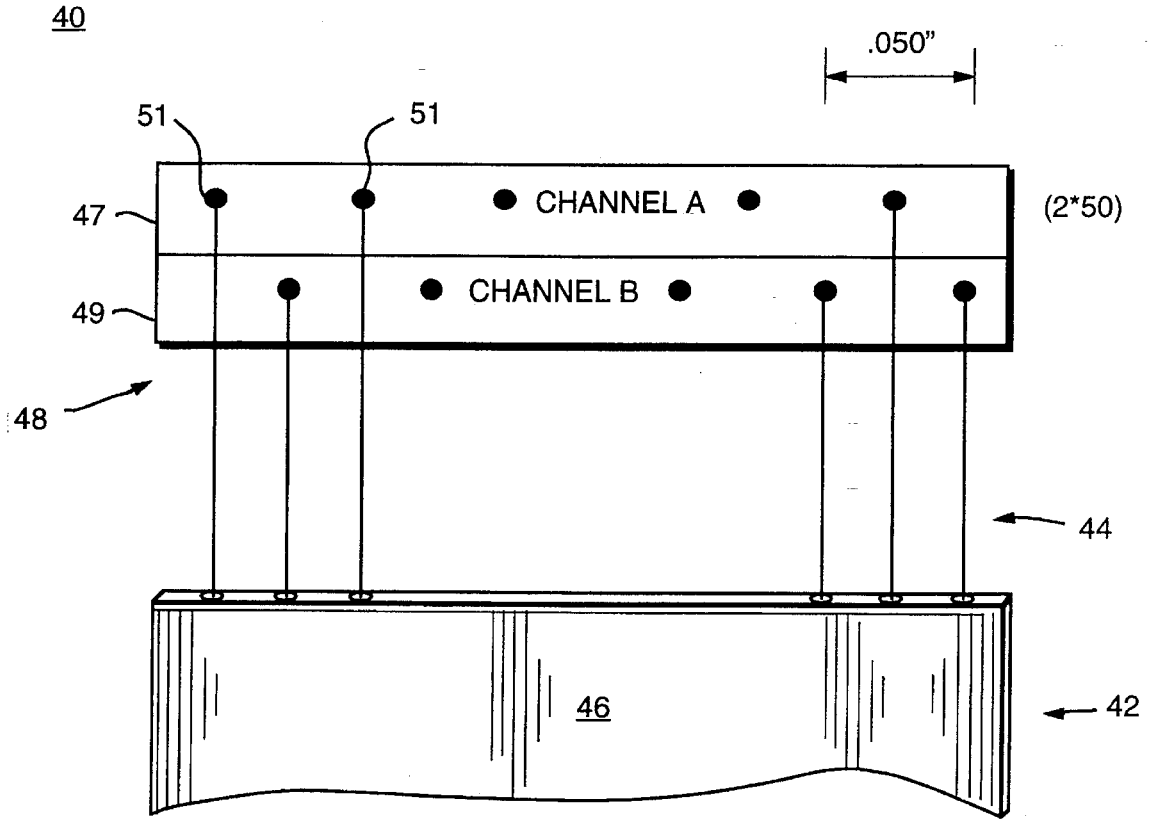

Referring now to FIG. 3A, generally designated at 40, is a schematic diagram of an alternative embodiment of a two-channel SCSI-compatible connector system in accord with the present invention. The system 40 includes a one-hundred (100) wire flat ribbon cable generally designated 42. In one embodiment, the flat ribbon cable 42 includes one hundred (100) wires 44 embedded in a conventional type of insulative sheath 46, such as poly-vinyl-chloride (PVC). Woven cables such as made by Woven Electronics of Mauldin, S.C. are also considered within the scope of the present invention. The wires of the one hundred (100) wire flat ribbon SCSI connector cable 42 are spaced 0.025" on center and arranged such that a ground wire alternates between signal wires (control/data) to eliminate cross-talk between two (2), fifty (50) wire SCSI single-ended channels.

A two (2) row by fifty (50) pin connector generally designated 48 is provided having connection pins arranged into two (2) channels marked "A" and "B" corresponding to rows 47 and 49, where each channel is fifty (50) connector pins in length, as illustrated. The inter-pin spacing of the connector pins 51 of the two (2) by fifty (50) connector 48 is fifty thousandths (0.050) inches, so that the footprint of the one hundred (100) pin connector 48 is the same as the footprint of a conventional two (2) row by twenty-five (25) pin (50 pin total) SCSI connector of the known type having 0.100 inch spacing.

As illustrated, fifty (50) of the wires of the one hundred (100) wire flat ribbon cable 42 are terminated to the connector ports of the channel "A" row 47 of connector 48, and the remaining fifty (50) wires of the flat ribbon SCSI cable 42 are connected to the connector pins of channel "B", row 49, of the connector 48, as illustrated. In this manner, a single connector 48, whose footprint matches that of the known conventional two (2) row by twenty-five (25) pin connectors, is able to support two (2) SCSI channels on the interconnection board 26 (FIG. 1) of the bus controller 20 including ground wires and pins, thereby doubling the channel handling capability of the interconnection port for a given area.

Figure 3B:
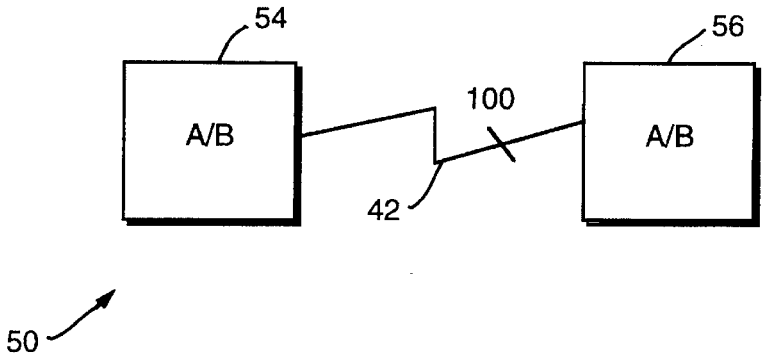
FIG. 3B is a block diagram illustrating a first alternative of the two-channel SCSI-compatible interconnection system and method of the present invention.

In FIG. 3B, generally designated at 50 is a block diagram illustrating one termination configuration for the two-channel SCSI-compatible interconnection system of FIG. 3A. As shown therein, the single one hundred (100) wire flat ribbon cable 42 is connected at its ends to first and second two (2) row by fifty (50) pin connectors 54, 56, respectively. Each connector 54, 56 is able to handle two-channels, but whose footprints only occupy the footprint of a conventional, single-channel two (2) row by twenty-five (25) pin SCSI connector.

Figure 4A:
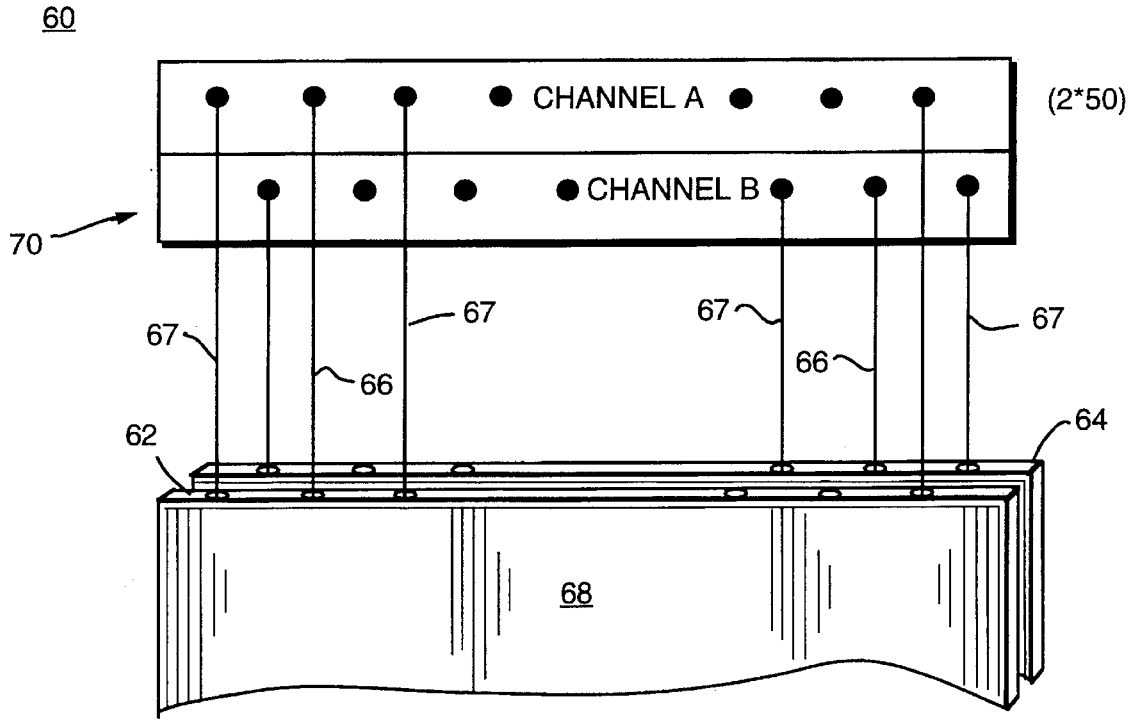

Referring now to FIG. 4A, generally designated at 60 is another embodiment of the two-channel SCSI-compatible interconnection system in accord with the present invention. The system 60 includes a first fifty (50) wire connector generally designated 62 and a second fifty (50) wire flat ribbon SCSI connector generally designated 64. The flat ribbon cable SCSI cables 62, 64 each include fifty (50) wires 66 embedded in an insulative sheath 68. Alternate or every other of the wire 66 of the two (2) flat ribbon SCSI cables 62, 64 are ground wires that eliminate cross-talk between the signal wires 67 (control and data) of the respective cables 62, 64. The insulative material 68 may include conventional material such as poly-vinyl-chloride (PVC). Alternatively, woven cable may be utilized.

A connector generally designated 70 is provided having connection ports arrayed in a two (2) by fifty (50) array. Fifty (50) of the pins along one (1) row are designated as channel "A", while the remaining fifty (50) connector ports are arranged as channel "B", as illustrated. The fifty (50) conductors 66 of the flat ribbon cable 62 are selectably terminated to and electrically interconnected with the connector ports of the channel "A", whereas the fifty (50) conductors 66 of the flat ribbon cable 64 are terminated to and electrically interconnected with the connector ports of the channel "B", as illustrated.

Interport spacing of the connector ports of the two (2) row by fifty pin (50) connector 70 have a fifty thousandths (0.050) inch spacing, so that the footprint of the connector 70 matches the footprint of a conventional two (2) row by twenty-five (25) pin SCSI connector with standard 0.100 inch spacing thereby enabling the connector 70 to support two (2) SCSI channels on the interconnection board 26 (FIG. 1) of the bus controller 20 where the heretofore known connector would only support one (1) channel, thereby doubling the SCSI channel carrying capacity in the present invention.

Figure 4B:
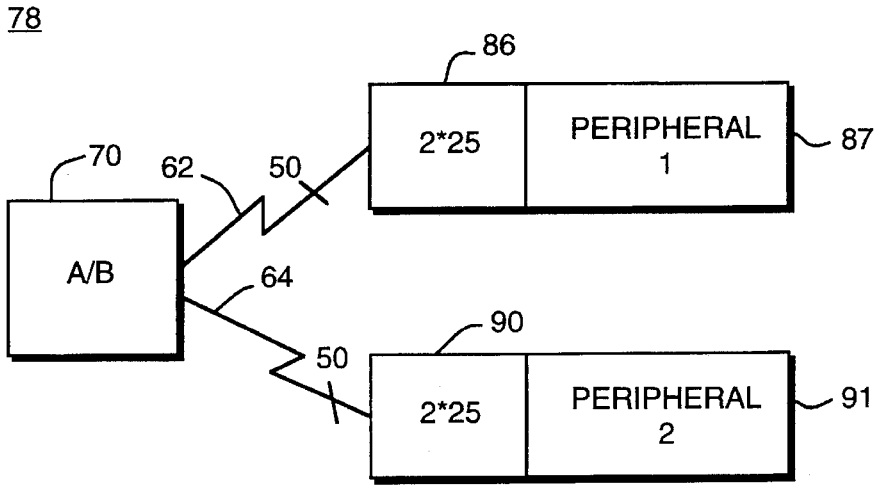
FIG. 4B is a block diagram illustrating yet another embodiment of the two-channel SCSI-compatible interconnection system and method of the present invention.

In FIG. 4B, generally designated at 78 is a block diagram illustrating one termination configuration of the two-channel SCSI-compatible interconnection system in accordance with the present invention as described in conjunction with FIG. 4A. A two (2) row by fifty (50) pin connector 70, whose footprint matches that of the conventional two (2) row by twenty-five (25) pin SCSI connector of the prior art, is connected via a first fifty (50) wire cable 62 to a conventional two (2) row by twenty-five (25) pin connector 86, generally coupled to a first peripheral 87, such as a first disk drive. A second fifty (50) wire SCSI flat ribbon cable 64 is connected to a second conventional two (2) row by twenty-five (25) pin SCSI connector 90, generally coupled to a second peripheral 91, such as a second disk drive.

Accordingly, the several embodiments of the present invention provide a system for doubling the signal-carrying capability of a conventional peripheral interface such as the SCSI interface and protocol, thereby reducing in half the space required on an interface or controller board, to couple to the peripherals.

Modifications and substitutions by one of ordinary skill in the art are considered to be within the scope of the present invention which is not to be limited except by the claims which follow.

What is claimed is:

1. A computer data communication channel cable interconnection system, for at least doubling the channel carrying capacity of a given area on an interconnection board to which a plurality of data communication devices are connected, comprising:

at least one data communication cable having a plurality of signal carrying wires, each of said plurality of wires separated from adjacent wires by a dielectric material, said plurality of wires for providing signal carrying capability for at least two data communication channels; and at least one dual channel data communication connector, coupled to at least a first end of said at least one data communication cable, for connecting said at least one data communication cable carrying said at least two data communication channels to said interconnection board in an area generally occupied by a connector coupled to one data communication channel.

2. The interconnection system of claim 1, wherein said at least two data communication channels include two small computer system interface (SCSI) communication channels.

3. The interconnection system of claim 2, wherein said at least one data communication cable includes a fifty (50) wire flat ribbon cable.

4. The interconnection system of claim 1, wherein said dielectric material includes TEFLON®.

5. The interconnection system of claim 3, wherein said at least one dual channel data communication connector includes a two (2) row by twenty-five (25) position connector; and wherein a first of said two SCSI communication channels is coupled to a first row of said two (2) row by twenty-five (25) position connector, and a second of said two SCSI data communication channels is connected to a second row of said two (2) row by twenty-five (25) position connector.

6. The interconnection system of claim 5, wherein said at least one dual channel data communication connector includes a two row by 32 position connector.

7. The interconnection system of claim 5, wherein adjacent connector positions in each of said first and second rows of said two (2) row by twenty-five (25) position connector are spaced 0.100 inches apart.

8. A method for increasing the SCSI communication channel carrying capacity of a SCSI bus controller interconnection board in a computer system having at least one SCSI bus controller and a plurality of peripheral devices such connected to said SCSI bus controller by means of said SCSI bus controller interconnection board, wherein respective ones of a corresponding plurality of fifty (50) wire flat ribbon cables connect each of said plurality of peripheral devices individually to the SCSI bus controller interconnection board, wherein each fifty (50) wire flat ribbon cable has preselected control, data and ground signal carrying wires so preassigned that a ground signal wire alternates with and separates wires carrying one of said control and said data signals to eliminate cross-talk in the cable, and wherein each adjacent signal wire of said fifty (50) wire SCSI flat ribbon cable is embedded in a dielectric material having a dielectric constant selected to eliminate cross-talk between said each adjacent wire, said method comprising the steps of:

not providing a SCSI ground signal on said ground signal wire between the data and control signal carrying wires of each of said fifty (50) wire flat ribbon cables in order to free the ground signal carrying wires thereof for carrying control and data signals of a SCSI channel; and terminating the thus-freed ground wires as well as the control and data wires of at least one end of each of said fifty (50) wire flat ribbon SCSI cable to a corresponding connector, to enable each connector to carry data and control signals for first and second SCSI communication channels.

9. The method of claim 8, wherein said dielectric material has a dielectric constant in the range of 1.3 to 2.1.

10. The method of claim 8, wherein said dielectric material includes TEFLON®.

11. A method for increasing the SCSI channel carrying capacity of a SCSI bus controller interconnection board in a computer system having at least one SCSI bus controller and a plurality of peripheral devices each connected to said SCSI bus controller by means of said SCSI bus controller interconnection board, wherein first and second ones of said plurality of peripheral devices are coupled to said SCSI bus controller interconnection board by means of one dual SCSI channel communication cable including wires embedded in a dielectric material, comprising the steps of:

providing a SCSI bus controller interconnection board connector coupled to at least a first end of said one dual channel SCSI communication cable, for terminating two (2) SCSI data communication channels at said SCSI bus controller interconnection board, said connector having a predetermined dimension which matches a predetermined dimension of a conventional single channel SCSI connector; and coupling said at least one dual SCSI channel data communication cable to said first and second peripheral devices.

12. The method of claim 11, wherein said at least one dual SCSI channel communication cable includes a cable with interwoven adjacent wires.

* * * * *